United States Patent [19]

Turner

[11] Patent Number: 4,783,864.

[45] Date of Patent: Nov. 15, 1988

[54] PRODUCING SUBCONSCIOUS INTEGUMENTAL REFLEX ACTION TO KEEP CHILDREN AWAY FROM GUARD RAIL WHILE SLEEPING ON BUNK BED

[76] Inventor: Ronald L. Turner, 4535 E. Marilyn, Phoenix, Ariz. 85032

[21] Appl. No.: 80,659

[22] Filed: Aug. 3, 1987

[51] Int. Cl.[4] ..... A47C 21/08

[52] U.S. Cl. ..... 5/424; 5/425; 5/427; 5/512

[58] Field of Search ..... 5/9 R, 9 B, 100, 424–427, 5/512

[56] References Cited

U.S. PATENT DOCUMENTS

| | | | |
|---|---|---|---|
| 3,742,530 | 7/1973 | Clark | 5/425 X |
| 4,215,446 | 8/1980 | Mahoney | 5/425 |
| 4,232,415 | 11/1980 | Webber | 5/427 |
| 4,370,765 | 2/1983 | Webber | 5/427 |

FOREIGN PATENT DOCUMENTS

| | | | |
|---|---|---|---|
| 242346 | 2/1911 | Fed. Rep. of Germany | 5/427 |

*Primary Examiner*—Michael F. Trettel
*Attorney, Agent, or Firm*—Nissle & Leeds

[57] ABSTRACT

Method and apparatus for producing subconscious integumental reflex action to keep children away from a guard rail while sleeping on a bunk bed.

4 Claims, 1 Drawing Sheet

Figure 1:
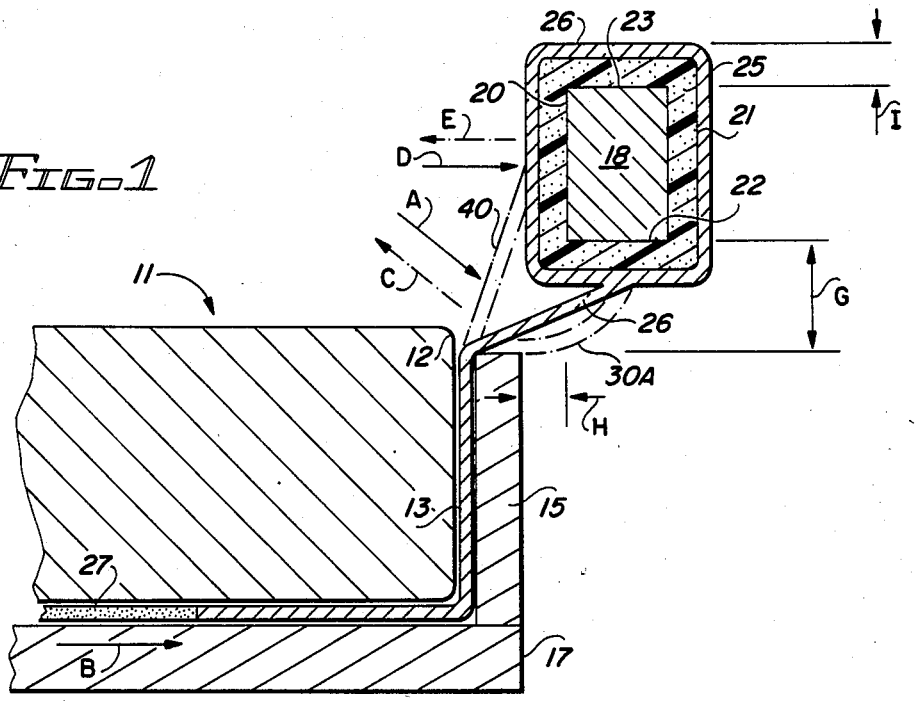

PRODUCING SUBCONSCIOUS INTEGUMENTAL REFLEX ACTION TO KEEP CHILDREN AWAY FROM GUARD RAIL WHILE SLEEPING ON BUNK BED

This invention pertains to bedding.

More particularly, the invention pertains to a method and apparatus for greatly reducing the likelihood that a sleeping child's legs, arms and body will slip between the guard rail and mattress of a bunk bed such that the neck and throat of the child are lodged between the guard rail and mattress.

In a further respect, the invention pertains to a method for reducing the likelihood of a sleeping child's limbs slipping between the guard rail and mattress of a bunk bed, the method producing an integumental sensation in the child's body which is different from learned subconscious integumental sensations and which causes the child to draw away from the guard rail and toward the center of the mattress of the bunk bed.

In still another respect, the invention pertains to a method of the type described in which the likelihood of a child's limbs slipping between the guard rail and mattress of a bunk bed is reduced by producing an increased compressive force against the limb of the child when the limb which contacts the guard rail or moves intermediate the guard rail and mattress, the increased compressive force resulting in a reflex action by the child which causes the child to move away from the compressive force and from the guard rail.

A particular hazard associated with bunk beds is that the limbs and body of a resting child can slide downwardly between the guard rail and mattress of the bed, causing the child's head and neck to wedge between the guard rail and mattress. When this occurs the child can choke to death. The conventional solution to this problem is described in U.S. Pat. Nos. 4,232,415 and 4,370,765 to Webber. The Webber patents describe a bunk bed system in which protective sheets span the distance between the guard rail and bunk bed mattress and remain taut and generally fixed in place during utilization of a bunk bed. The taut sheet utilized in the Webber patents functions much like a panel of wood or other rigid material interposed between the guard rail and mattress and, accordingly, simply blocks the space between the rail and mattress and provides support for a limb contacting the sheet. The taut sheet system utilized in Webber does not discourage a child from lying on, near or against the guard rail. Further, in a bunk bed equipped with the Webber sheet system a hand or foot of a child can work between the taut sheet and side of the mattress and become entangled or difficult to remove. The likelihood of such entanglement occurring would be substantially reduced if the child or other individual sleeping in the bunk bed would not position his limbs at the edge of the mattress immediately adjacent the guard rail. If the child kept his limbs away from the guard rail this would also reduce the likelihood that the child would, while sleeping or dozing, manage to inadvertently climb or roll over the guard rail and fall to the floor, incurring serious injury.

Accordingly, it would highly desirable to provide a bunk bed system which would tend to automatically cause a resting child or other individual reclining on the bed to position his or her limbs and body away from the guard rail to minimize the likelihood that the limbs and body will slide between the guard rail and the mattress, will slide between the mattress and frame supporting the mattress, or will hang over the guard rail in a position outside of the bunk bed.

Therefore, it is a principal object of the invention to provide an improved bunk bed safety system.

A further object of the invention is to provide an improved method and apparatus for preventing an individual's limbs from sliding between the guard rail and mattress or from hanging over the guard rail and outside the bunk bed.

Another object of the invention is to provide an improved method for reducing the likelihood of a child's choking to death in a bunk bed after the arms and limbs of the child slid outwardly between the guard rail and mattress, the improved method producing an integumental sensation in the child's body to cause the sleeping child to draw his limbs away from the guard rail and toward the center of the mattress of the bunk bed.

Still a further object of the invention is to provide an improved method of the type described in which the likelihood of a resting child's limbs slipping between the guard rail and mattress of a bunk bed is reduced by producing an increased compressive force against an arm or leg pressed against the guard rail or intermediate the guard rail and mattress, the increased compressive force generally resulting in a reflex action by the child which causes the child to withdraw and move away form the compressive force.

Figure 2:
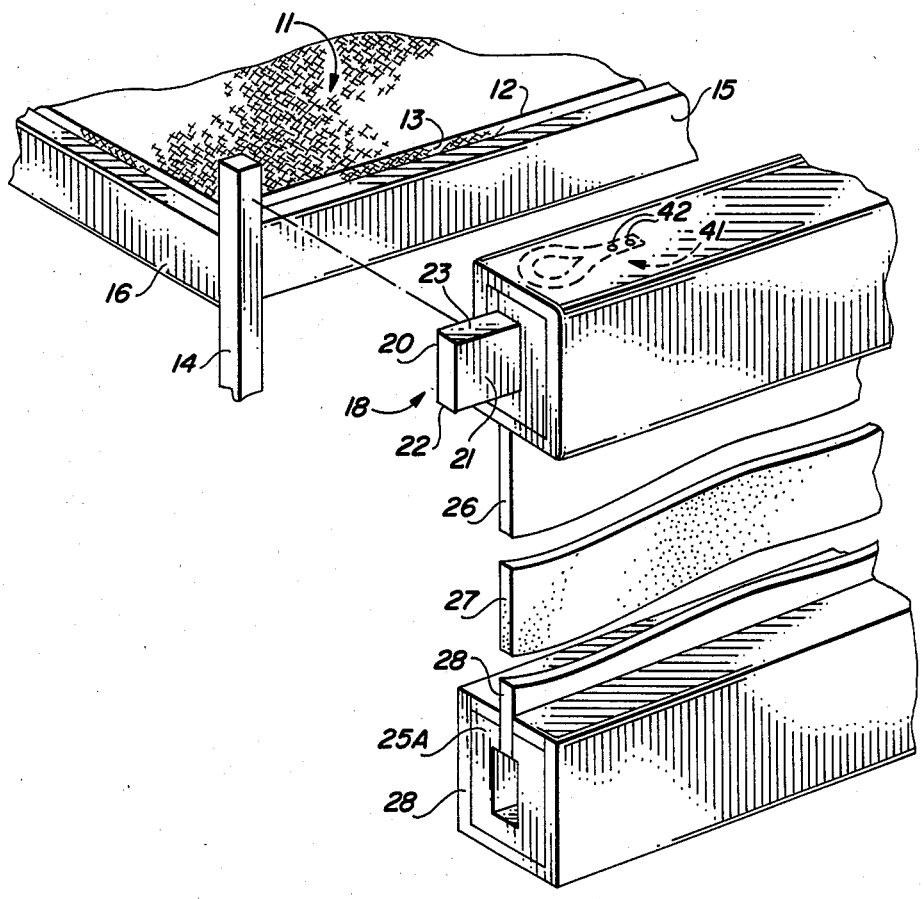

These and other, further and more specific objects and advantages of the invention will be apparent to those skilled in the art from the following detailed description thereof, taken in conjunction with the drawings, in which:

FIG. 1 is a side section elevation view illustrating a bunk bed constructed in accordance with the principles of the invention; and, FIG. 2 is a perspective view illustrating a bunk bed equipped with apparatus constructed in accordance with the invention.

Briefly, in accordance with my invention, I provide means, in a bunk bed, for producing a compressive integumental sensation in an individual's limbs to produce a reflex action which reduces the likelihood that the limbs will slide downwardly between the guard rail and mattress of the bunk bed. The bunk bed also includes a frame carrying the mattress. The elongate guard rail is spaced a distance apart and upwardly from the mattress and has inner and lower surfaces extending substantially the entire length of the rail. The distance between the mattress and guard rail is sufficient to permit the arms and legs of a child of a selected size to slid downwardly between the guard rail and mattress. The means includes first elastic means secured over and covering the inner and lower surfaces of the guard rail and compressible when the limb of an individual bears thereagainst to conform to the limb and generate an integumental compression sensation on the limb to produce a reflex action to cause the individual to move his limb, and generate an elastic expansive displacement force acting outwardly away from the guard rail on the limb, the displacement force requiring the individual to utilize his muscular system to generate a force opposing the displacement force to maintain his limb in position against the compressed elastic means, the elastic means including a layer of material generally continuously extending along the length of the guard rail, the layer of material having a thickness of at least one half inch at each point along the covered inner and lower portion of the guard rail; a sheet of pliable material secured to the guard rail and extending from the guard rail along substantially the entire length of the rail and across the distance between the guard rail and the mattress; and, second elastic means beneath the mattress and attached to the sheet, the second elastic means—pliable sheet combination, when a limb of the individual bears against and displaces the sheet outwardly from the mattress, conforming to the limb and generating an integumental compression sensation on said limb to produce a reflex action to cause the individual to move his limb inwardly toward the mattress and generating an elastic return force acting inwardly toward the mattress on the limb, the return force requiring the individual to utilize his muscular system to generate a force opposing said return force to maintain his limb in position against the displaced sheet.

In an alternate embodiment of the invention I provide a method for improving the safety of a child sleeping in a bunk bed. The bunk bed includes a frame, mattress means carried in the frame and having a peripheral edge, and an elongate substantially rigid guard rail having elongate inner and lower surfaces extending along substantially the entire length of the rail, the rail being spaced a distance laterally and upwardly from the mattress means, the distance being sufficient to permit the limbs of the child to slide downwardly intermediate the guard rail and mattress. The method counteracts learned integumental sensations of a child and produces an integumental compression sensation to the child's body to produce a reflex action and reduce the likelihood that the limbs of the child will slide downwardly between the guard rail and mattress. The method comprises the steps of having the child sleep in the bunk bed and contact the inner surface of the guard rail with his limbs to experience and develop learned integumental sensations; securing elastic means over and covering the inner and lower surfaces of the guard rail, the elastic means compressing when the limb of the child bears thereagainst to conform to the limb and to generate a subconscious integumental compression sensation on the limb different from the learned subconscious integumental sensations to produce a reflex action causing the child to move his limb and to generate an elastic expansive displacement force acting outwardly away from the guard rail on the limb, the displacement force requiring the child to utilize his muscular system to generate a force opposing the displacement force to maintain his limb in position against the compressed elastic means, the elastic means including a layer of material generally continuously extending along the length of the guard rail; and, attaching a sheet of pliable material to the guard rail and extending the sheet from the rail to second elastic means, said second elastic means being intermediate said mattress means and frame and permitting said sheet to be elastically displaced a selected distance outwardly from the mattress means between the mattress means and the guard rail when the limb of a child bears against the sheet, to generate an elastic return force acting inwardly toward the mattress means and against the limb to cause the child to utilize his muscular system to generate a force opposing the elastic return force to maintain his limb in position against the sheet, and to conform to the limb and generate an integumental compression sensation on the limb different from the learned integumental sensations to produce a reflex action causing the child to move his limb away from the guard rail.

Turning now to the drawings, which depict the presently preferred embodiment and best mode of the invention for the purpose of illustrating the practice thereof and not by way of limitation of the scope of the invention and in which like reference characters illustrate corresponding elements throughout the several views, FIGS. 1 and 2 illustrate a bunk bed constructed in accordance with the principles of the invention and including a mattress 11 having a peripheral upper edge 12 and side wall 13 each circumscribing the mattress. A conventional bunk bed frame includes a vertical corner post 14 and elongate horizontal two inch by six inch wood panels 15, 16. Another pair of horizontally oriented elongate panels, each parallel to and spaced apart from one of panels 15, 16 are not visible in FIGS. 1 and 2. Panels 15, 16 and the other pair of horizontal elongate panels form a support rectangle which circumscribes mattress 11. Horizontal panel 17 is attached to the bottom of the rectangle formed by panels 15, 16 and the other pair of horizontal elongate panels. Mattress 11 rests on panel 17. Posts, identical and parallel to post 14, are, in conventional fashion, at each of the other three corners of the support rectangle. Elongate horizontally oriented guard rail 18 has an inner surface 20 normally attached to the upper portion of post 14 and a second end (not shown) attached to another corner post 14 (not visible). Guard rail 17 includes inner 20, outer 21, lower 22 and upper 23 surfaces. Elastic compressible foam material circumscribes and generally continuously extends the entire length of guard rail 18. Pliable sheet 26 spans the distance between the foam coated guard rail 15 and mattress 11. Sheet 26 is attached to elastic material 27 positioned intermediate mattress 11 and panel 17. Material 27 can, if desired, be positioned intermediate side 13 and panel 15. When the limb of an individual presses outwardly against sheet 26 in the direction of arrow A, elastic 27 expands in the direction of arrow B to permit sheet 26 to move in the direction indicated by arrow A to a distended position like that represented by dashed lines 30. When sheet 26 is in a distended position 30, elastic 27 is pulling on sheet 26 in a direction opposite the direction of arrow B to generate an integumental compression sensation on the limb of the child and to generate an elastic return force, indicated by arrow C. The integumental compression sensation produces a pressure against the skin and flesh of the child which typically eventually causes the child to move the limb inwardly in the direction of arrow C away from guard rail 18 and toward the center of mattress 11. The elastic return force C is sufficient to require the child to utilize his muscular system to generate a force opposing the elastic return force to maintain his limb in position against the displaced sheet. The child's muscular system eventually tires, causing the child to retract his arm, leg, head, etc., inwardly away from guard rail 18 toward the center of mattress 11.

When the limb of a child bears against compressible elastic material 25 in the direction of arrow D, an integumental compression sensation and an elastic expansive displacement force are generated. The integumental compression sensation produces a pressure against the skin and flesh of a child which typically eventually causes the child to move the limb inwardly in the direction of arrow E away from guard rail 18. The child's limb bearing against material 25 produces an integumental sensation because the expansive force generated by material 25 in attempting to return to its normal position illustrated in FIG. 1 causes the nervous system of the child to integumentally sense or feel the pressure against his arm. This pressure commonly causes a reflex act in which nervous impulses are transmitted inward by afferent fibers from a receptor to a nerve center and commonly through adjustor neurones outward by efferent fibers to an effector muscle which moves the limb away from rail 18.

When one person gently steps on or puts pressure on a second individual's foot, the reflex action of the second individual is to pull the foot away. If one standing person gently places his hand on and presses against the shoulder of a second adjacent standing individual, the reflex action of the second individual is to move his shoulder away. In general, when a pressure is applied to a portion of a person's body, the normal reflex action is, if it is not possible to readily remove the source of the pressure, to move the body away from the pressure, particularly if it requires muscular exertion to offset the pressure being externally applied to the body. The tendency of the body to pull away from a continued externally applied compressive force is important in the practice of the invention, as is the elastic return force generated by sheet 25 and the elastic expansive force generated by material 25. Simply pressing the limb of an individual against a rigid guard 18 would compress the flesh of the limb; however, material 25 and sheet 25 generate forces C and E, respectively, which increase the integumental pressure on the limb and also cause the individual to exert muscular energy to maintain the limb against and maintain the compression of material 25 and maintain the elastic displacement of sheet 26. It is important that the elastic return force C and the elastic expansive force E are sufficient to cause an individual to exert muscular energy to maintain a limb in position against compressed material 25 and displaced sheet 30. This exertion of muscular energy eventually causes the individual to tire and move his limb away from rail 18 toward the center of mattress 11.

This is especially the case for a child or individual who is resting or sleeping. While sleeping, the body constantly "hunts" for the most comfortable, relaxed position. It is important that material 25 extend continuously along rail 18 such that there are not "low spots" or areas without a layer of material 25. Low spots are avoided because they provide an area against which an individual can press a limb with generating an elastic expensive force.

Sheet 26 can comprise a continuous sheet of material, netting, etc. as long as sheet 25 can be displaced a short distance in the direction of A. Elastic 27 permits sheet 26 to be displaced only a relatively short distance in the direction of arrow A so that the limb of an individual cannot extend out past guard rail 25. The pliability and displaceability of sheet 26, along with the compressibility of material 25, are important because this permits material 25 and sheet 26 to wrap around and contour to the shape of the limb bearing against material 25 and sheet 26. When material 25 and sheet 26 contour to the shape of the limb they apply pressure over a greater surface area of the limb, producing an integumental compression sensation which is different from that which occurs when the limb bears against a hard rigid surface. The different integumental compression sensation produced by material 25 and sheet 26 tends to cause a child to withdraw his limb from contact with the same.

In FIG. 1, the distance G from the bottom surface 22 of rail 18 to the top of member 15 (and, approximately, to the top of mattress 11) is typically five to six inches; the distance H from inner surface 20 to member 15 is typically one to two inches. When material 25 is slid over, glued to, or otherwise secured over rail 18, it significantly reduces the size of the gap between rail 18 and mattress 11 and panel 15. Material 25 preferably has a thickness of at least 0.5 inch.

In FIG. 2, sheet 28 is connected to elastic 27 and circumscribes elastic compressible foam material 25A. Material 25A slides onto, is glued, or is otherwise secured around another horizontal guard rail which is spaced apart from, parallel to, and at the same elevation as rail 18.

The sheet in FIGS. 1 and 2 is illustrated as contouring to, closely fitting, and being attached to material 25. If desired, sheet 26 can, as indicated by dashed lines 40, extend from inside rail 18 downwardly toward mattress 11. Sheet 26 need not fully circumscribe material 25, can loosely slidably fit over material 25, can (if material 25 does not entirely circumscribe rail 18) be fixedly connected to rail 18, or can only contact and be attached to material 25 along a continuous line parallel to rail 18.

The loop 41 illustrated in FIG. 2 is attached to sheet 26 at points 42 and is stretched over the top of corner post 14 to prevent material 25 and sheet 26 from sliding down rail 18 away from post 14. Elastic 27 can be maintained in position by the weight of mattress 11 or can be attached to mattress 11 or panel 17.

Material 25 can be utilized on a bunk bed without sheet 26 and elastic 27, and vice versa. Elastic 27 can be sized such that sheet 26 will fit bunk beds of varying size.

In the practice of the invention, it is crucial that material 25 and elastic 27 have sufficient elastic resistance or "spring" to generate significant elastic expansive forces and elastic return forces, respectively, when the arm of an individual bears against the same. The elastic expansive forces and elastic return forces cause the muscular system of an individual, particular a sleeping individual, to tire and move away from the guard rail. Some soft foams, when compressed, generate elastic expansive forces of such small magnitude that they have no effect, even on a young baby. Such forms are inappropriate in the practice of the invention. An individual does not have to expend any muscular exertion to maintain a limb against such foams.

In practing the method of the invention, it is preferred to allow a child or other individual to initially sleep on a bunk bed not equipped with the elastic apparatus of FIGS. 1 and 2. This permits the subject, while sleeping and contacting the bare bunk bed guard rails with his limbs, body, and head, to develop learned subconscious integumental sensations. These sensations are distinct from the subconscious integumental compression sensations encountered when the bunk bed is equipped in accordance with the invention. This difference between the learned subconscious integumental sensations and the subconscious integumental compression sensations encountered with the apparatus of the invention makes the invention more useful and effective.

Elastic foams are designated by a four digit number. The first two digits indicate the denisty of the foam. The second two numbers indicate the compression rating of the foam. An 1933 foam is often utilized in the seat cushions of a sofa. The first two digits, 18, indicate the density of the foam, while the second two digits, 33, indicate the compresion rating of the foam. In most commercially available formas the first two digits are in the range of 10 to 50 and the secon two digits are in the range of 0 to 71. In the practice of the invention, it is preferred that the density rating of the foam be in the range.of 14 to 50 and that the compression rating be in the range of 12 to 35. While elastic foams can be manufactured from a variety of materials, urethan foams are widely available. Foam having a compresion rating of 10 or less are too soft to be utilized in the practice of the invention, while foams having a compression rating exceeding 35 are two stiff to be utilized in the invention.

EXAMPLE I

A five (5) year old male subject is permitted to sleep on a bunk bed for five (5) consecutive nights. An observer is present. The subject moves around on the bed while sleeping and contacts the guard rails of the bunk bed on numerous occasions with his hands, feet, arms, legs, head and body. On several occasions the arms or legs of the subject extend partially outwardly from the mattress intermediate a guard rail and mattress. On such occasions the observer repositions the body of the subject to insure it does not also slip between the guard rail and mattress. The subject is three feet, one inch high, of average build and weighs forty (40) pounds.

The bed is equipped in the manner illustrated in FIGS. 1 and 2 herein. Material 25 comprises a 1833 urethane foam. Elastic 27 comprises a plurality of strips of elastic of the type found in garter belts. Sheet 26 comprises mosquito netting made from a strong synthetic material. The netting is not elastic, but can be. The subject is allowed to sleep on the bed after it is equipped in the manner indicated in FIGS. 1 and 2. When the leg or arm of the subject contacts and displaces the material 25 or sheet 26, a subconscious integumental compression sensation causes a reflex action which makes the sleeping subject pull his arm or leg away from the guard rail toward the center of the mattress. After several hours the subject continues to move around the bed, but generally stays away from the peripheral areas of the mattress immediately adjacent the guard rails.

Having described my invention such terms as to enable those skilled in the art to understand and practice it and having identified the presently preferred embodiments and best mode thereof, I claim:

1. In a bunk bed including a frame a mattress carried in said frame, and an elongate guard rail spaced a distance apart and upwardly from said mattress and having inner and lower surfaces extending substantially the entire length of said rail, said distance being sufficient to permit the arms and legs of a child of a selected size to slid downwardly between said guard rail and mattress, means for producing a compressive integumental sensation in a sleeping individual's limbs to produce a reflex action which reduces the likelihood that said limbs will slide downwardly between said guard rail and mattress, including (a) elastic means secured over and covering said inner and lower surfaces of said guard rail and compressible when the limb of a sleeping individual bears thereagainst to conform to said limb and generate (i) an integumental compression sensation on said limb to produce a reflex action to cause the individual to move his limb, and (ii) an elastic expansive displacement force acting outwardly away from said guard rail on said limb, said displacement force requiring the individual to utilize his muscular system to generate a force opposing said displacement force to maintain his limb in position against said compressed elastic means, said elastic means including a layer of material generally continuously extending along the length of said guard rail, said layer of material having a thickness of at least one half inch at each point along said covered inner and lower portions of said guard rail;

(b) a sheet of pliable material secured to said guard rail and extending from said guard rail along substantially the entire length of said rail and across said distance between said guard-rail and said mattress; and, (c) elastic means beneath said mattress and attached to said sheet, said elastic means-pliable sheet combination, when a limb of the individual bears against and displaces said sheet outwardly from said mattress, conforming to said limb and generating (i) an integumental compression sensation on said limb to produce a reflex action to cause the individual to move his limb inwardly toward said mattress, and (ii) an elastic return force acting inwardly toward said mattress on said limb, said return force requiring the individual to utilize his muscular system to generate a force opposing said return force to maintain his limb in position against said displaced sheet.

2. The compressive integumental sensation means of claim 1 wherein said elastic means comprises a foam having a compression rating in the range of 12 to 35.

3. A method for improving the safety of a bunk bed, the bunk bed including a frame, mattress means carried in the frame and having a peripheral edge, and an elongate substantially rigid guard rail having elongate inner and lower surfaces extending along substantially the entire length of said rail, said rail being spaced a distance laterally and upwardly from said mattress means, said distance being sufficient to permit the limbs of a child of a selected size to slide downwardly intermediate said guard rail and mattress, said method including the steps of (a) having the child sleep in said bunk bed and contact said inner surface of said guard rail with his limbs to generate learned subconscious integumental sensations;

(b) securing first elastic means over and covering said inner and lower surfaces of said guard rail, said elastic means compressing when the limb of the sleeping child bears thereagainst to conform to said limb and generate (i) an integumental compression sensation on the limb to produce a reflex action causing the child to move his limb, and (ii) an elastic expansive displacement force acting outwardly away from said guard rail on said limb, said displacement force requiring the individual to utilize his muscular system to generate a force opposing said displacement force to maintain his limb in position against said compressed elastic means, said elastic means including a layer of material generally continuously extending along the length of said guard rail; and, (c) attaching a sheet of pliable material to said guard rail and extending said sheet from said rail to second elastic means, said second elastic means being intermediate said mattress means and frame and permitting said sheet (i) to be elastically displaced a selected distance outwardly from said mattress means between said mattress means and said guard rail when the limb of the child bears against said sheet, (ii) to generate an elastic return force acting inwardly toward said mattress means and against the limb to cause the child to utilize his muscular system to generate a force opposing the elastic return force to maintain the limb in position against said sheet, and (iii) to conform to the limb and generate a subconscious integumental compression sensation on the limb different from said learned subconscious integumental sensations to produce a reflex action causing the child to move his limb away from said guard rail.

4. The method of claim 3 wherein said elastic means comprises a foam having a compression rating in the range of 12 to 35 and a density rating in the range of 14 to 50.

* * * * *